US010624397B2

(12) United States Patent
Cheung

(10) Patent No.: US 10,624,397 B2
(45) Date of Patent: Apr. 21, 2020

(54) SHEATH FOR BRA WIRE RING AND METHOD FOR MANUFACTURING BRAS USING THE SAME

(71) Applicant: KAIPING KELIAN KNITTERS DEVELOPMENT CO., LTD, Guangdong (CN)

(72) Inventor: Suilung Cheung, Guangdong (CN)

(73) Assignee: KAIPING KELIAN KNITTERS DEVELOPMENT CO., LTD., Kaiping, Guangdong (CN)

( * ) Notice: Subject to any disclaimer, the term of this patent is extended or adjusted under 35 U.S.C. 154(b) by 58 days.

(21) Appl. No.: 15/975,263

(22) Filed: May 9, 2018

(65) Prior Publication Data

US 2018/0255841 A1 Sep. 13, 2018

Related U.S. Application Data

(63) Continuation of application No. PCT/CN2016/105192, filed on Nov. 9, 2016.

(30) Foreign Application Priority Data

Nov. 10, 2015 (CN) ..... 2015 1 0763145

(51) Int. Cl.
*A41C 3/12* (2006.01)
*A41C 3/00* (2006.01)

(52) U.S. Cl.
CPC ..... *A41C 3/122* (2013.01); *A41C 3/0007* (2013.01); *A41C 3/0021* (2013.01); *A41C 3/12* (2013.01)

(58) Field of Classification Search
CPC ..... A41C 3/122; A41C 3/12; A41C 3/0021; A41C 3/0007
USPC ..... 450/41, 43, 49, 51, 52
See application file for complete search history.

(56) References Cited

U.S. PATENT DOCUMENTS 6,106,363 A * 8/2000 Werner ..... A41C 3/122 450/41
6,206,753 B1 * 3/2001 Werner ..... A41C 3/122 450/41
7,429,205 B1 * 9/2008 Huang ..... A41C 3/142 2/267
8,672,727 B2 * 3/2014 LaRoux ..... A41C 3/0028 450/41

* cited by examiner

*Primary Examiner* — Gloria M Hale
(74) *Attorney, Agent, or Firm* — Muncy, Geissler, Olds & Lowe, P.C.

(57) ABSTRACT

The invention discloses a sheath for bra wire ring. It includes a hollow sheath body made of cloth, and there is a hollow part for holding the wire ring to be inserted in the hollow sheath body; it also comprises a core wire inserted in the hollow part, and the core wire slides relative to the hollow sheath body. Such design solves the problem of resistance when the wire rings are inserted into a flat bra wire ring sheath, resulting in that in the process of manufacturing bra, the phenomena of wrinkles and holes left on the surface of the sheath and the tightness of the sheath caused by inserting wire rings can be obviously improved, and making the product more beautiful and simultaneously enhancing the comfort of wearing the bra for females.

10 Claims, 3 Drawing Sheets

SHEATH FOR BRA WIRE RING AND METHOD FOR MANUFACTURING BRAS USING THE SAME

TECHNICAL FIELD

The invention relates to the technical field of bra, in particular to a sheath for bra wire ring and a method for manufacturing bras by using the sheath.

BACKGROUND

A bra plays an indispensable role to females' appearance shaping and health, and the wire ring under the bra cup has an effect of supporting and protecting the breasts. Since the wire ring can't be sewn together with other parts of the bra because of its material, a sheath for bra wire ring has been designed in the industry, so that the wire ring is combined with other parts of the bra through sewing the sheath for bra wire ring with the other parts of the bra into an integration and inserting the wire into the sheath. As a result, the manufacturing process and time of placing wire rings in the bra are reduced, and the discomfort to the skin caused by the stiff material of the wire rings is buffered, which eliminates the tension to the skin caused by the wire rings to a certain extent.

Although the known sheath for wire ring has the above advantages, the sheath can be easily flattened in the process of sewing to be flat, thus in the process of inserting the wire ring into the sheath, the wire ring may be prevented from insertion, so that the wire ring may be inserted into the sheath with multiple repeated insertions, causing that the stiff end of the wire ring may leave wrinkles or holes on the surface of the sheath during the repeated insertions. Furthermore, after the wire ring is inserted into the sheath, it will result in that the sheath is too tight to be fluffy. The formation of wrinkles or holes and the tightness of the sheath will not only affect the beauty of bra, also even affect the comfort of wearing the bra for females. Thus, it is quite necessary to improve the sheath for bra wire ring.

SUMMARY OF THE INVENTION

In view of the above-mentioned disadvantages of the existing sheathes for bra wire rings, the invention provides a sheath for bra wire ring, which has the advantages of improving the situation that there is resistance while the wire ring is inserted into the sheath.

In order to achieve the above-mentioned desired advantages, the invention provides a sheath for bra wire ring, comprising a hollow sheath body made of cloth, in which a hollow part for holding the wire ring to be installed is provided, also comprising a core wire penetrated through the hollow part, which may slide relative to the hollow sheath body, that is, the core wire is independent relative to the hollow sheath body, and the core wire can be pulled out as required. In the sewing process of the sheath according to the invention, owing to the support from the core wire, the sheath will not be flattened by the pressing foot of the sewing machine. Besides, after pulling out the core wire, a hollow part can be formed in the middle of the sheath for convenience of wire rings to pass through. Owing to the hollow part, the wire rings being inserted into the sheath will not result in wrinkles or holes on the surface or lead to tightness for users as mentioned in the background. In this way, the supported bra can maintain fluffiness at the position of the sheath and improve wearing comfort.

Preferably, the length of the core wire is not shorter than that of the hollow sheath body, and more preferably the length of the core wire is equal to that of the hollow sheath body.

Preferably, the width and thickness of the core wire are greater than those of the wire ring to be inserted, so that there is enough gap for inserting the wire ring to be inserted after the core wire is pulled out from the hollow sheath body, and the width and thickness of the core wire are configured that it can be easily inserted into the hollow sheath body.

Preferably, after the core wire is pulled out, in order to enable the wire ring to be easily inserted into the hollow sheath body, a sufficient gap shall be ensured between the hollow sheath body and the wire ring to be inserted, but the gap shall not be too big, so as to avoid affecting the effect of the sheath on fixing the wire ring. Therefore, the width ratio of the core wire to the hollow sheath body shall be between ⅓ and ¾, preferably between ½ and ⅔.

Similarly, in order to enable the wire ring to be easily inserted into the hollow sheath body without affecting the effect of the wire sheath on fixing the wire ring, the thickness ratio of the core wire to the hollow sheath body shall be between ¼ and ½.

A method for manufacturing a bra using the bra wire ring sheath according to the invention comprises the following steps:

1) Preparing a bra wire ring sheath according to the invention, comprising a hollow sheath body made of cloth, in which a hollow part for holding the wire ring to be inserted is provided, also comprising a core wire inserted in the hollow part, which may slide relative to the hollow sheath body and is woven and synchronously formed with the hollow sheath body, and is cut into multiple segments in the length matched with the lower edge of the bra cup after forming;

2) Sewing the sheath in a suitable position at the lower edge of the bra cup to make it in an arc shape;

3) Pulling out the core wire in the sheath to form a passage in the hollow sheath body for the wire ring to be inserted;

4) Inserting the wire ring from the port at one end of the passage of the hollow sheath body, and passing through the passage to the other end;

5) Seaming the port parts of the sheath to avoid the wire ring from penetrating out of the port parts of the sheath during wearing.

The invention has desired advantages that: such bra wire ring sheath adopting the above structure solves the problem of resistance when the wire ring is inserted into the flat bra wire ring sheath, resulting in that in the process of bra manufacturing, the phenomena of wrinkles and holes left on the surface of sheath and tightness of the sheath caused by inserting wire rings can be obviously improved, so that the product is full of beauty and simultaneously enhances the comfort of wearing the bra for females.

DETAILED DESCRIPTION OF THE PREFERRED EMBODIMENTS

The invention will be further explained by combining with the specific embodiments below. Wherein, the attached drawings are only used for exemplary description, representing the schematic diagrams only, rather than pictures of real product, and it is not to be understood that the invention is limited to the drawings and embodiments.

Figure 1:
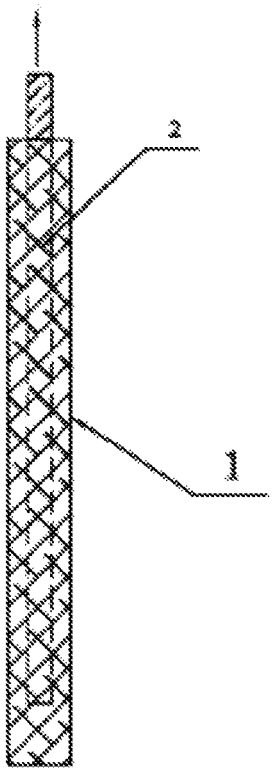
FIG. 1 shows a schematic plan view according to the invention.
Figure 2:
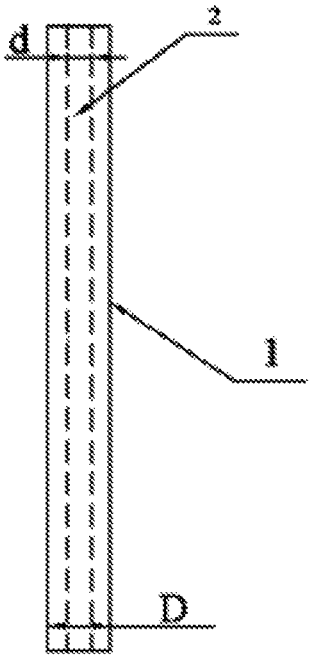
FIG. 2 shows a schematic view according to the invention.
Figure 3:
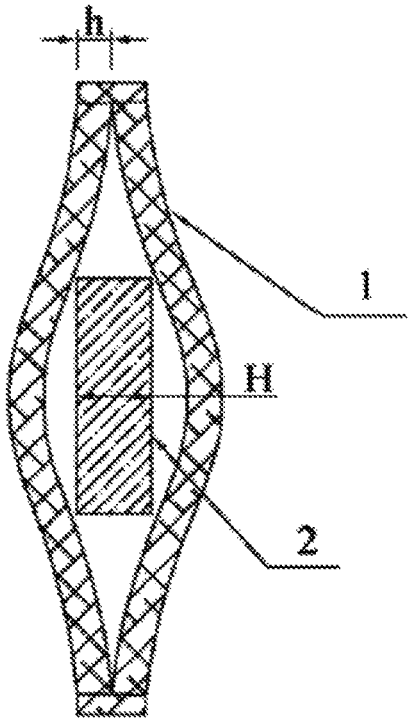
FIG. 3 shows a cross section view according to the invention.

As shown in FIGS. 1-3, a sheath for bra wire ring according to the invention comprises a hollow sheath body made of cloth, in which a hollow part for holding the wire ring to be installed is provided and also comprises a core wire penetrated through the hollow part, which may slide relative to the hollow sheath body. The core wire 2 is independent relative to the hollow sheath body 1 and can be pulled out from the hollow sheath body 1 as required. The length of the core wire 2 is not shorter than that of the hollow sheath body 1, and more preferably the length of the core wire is equal to that of the hollow sheath body. The width d and thickness h of the core wire are greater than those of the wire ring to be installed, so that there is enough gap for inserting the wire ring to be installed after the core wire is pulled out from the hollow sheath body, and the width d and thickness h of the core wire are configured that it can be easily inserted into the hollow sheath body.

After the core wire is pulled out, in order to enable the wire ring to be easily inserted into the hollow sheath body, a sufficient gap shall be ensured between the hollow sheath body and the wire ring to be inserted, but the gap shall not be too big, so as to avoid affecting the effect of the sheath on fixing the wire ring. Therefore, the ratio (d/D) of the width d of the core wire to the width D of the hollow sheath body shall be between ⅓ and ¾, preferably between ½ and ⅔.

Similarly, in order to enable the wire ring to be installed to be easily inserted into the hollow sheath body without affecting the effect of the wire sheath on fixing the wire ring, the ratio (h/H) of the thickness h of the core wire to the thickness H of the hollow sheath body shall be between ¼ and ½.

To manufacture a bra using the bra wire ring sheath according to the invention, firstly a bra wire ring sheath according to the invention is manufactured, comprising a hollow sheath body 1 made of cloth, in which a hollow part for holding the wire ring to be inserted is provides, also comprising a core wire 2 penetrated through the hollow part, which may slide relative to the hollow sheath body 1. The core wire 2 is woven and synchronously formed with the hollow sheath body 1, and after forming the sheath is cut into multiple segments in the length matched with the lower edge of the bra cup.

Figure 4:
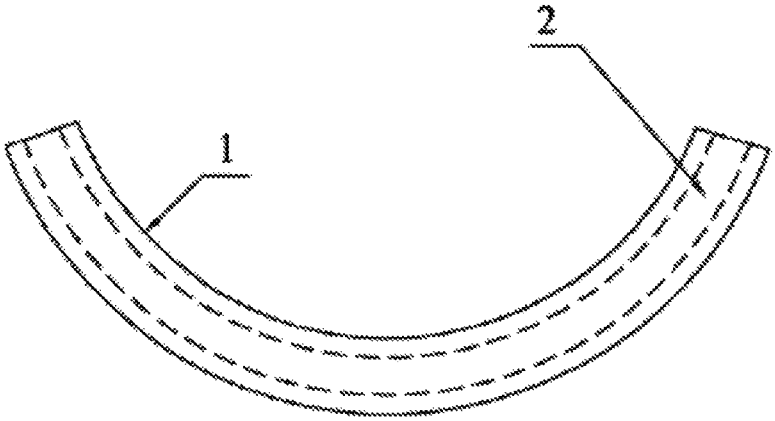
FIGS. 4(*a*) to 4(*c*) shows a schematic view of a using method according to the invention.
Figure 4:
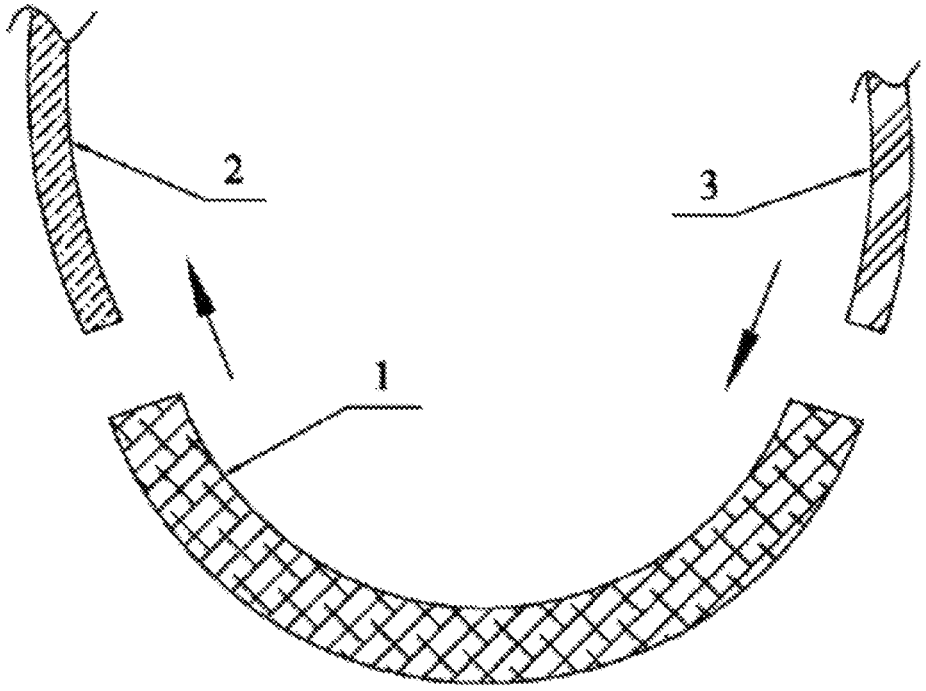
Figure 4:
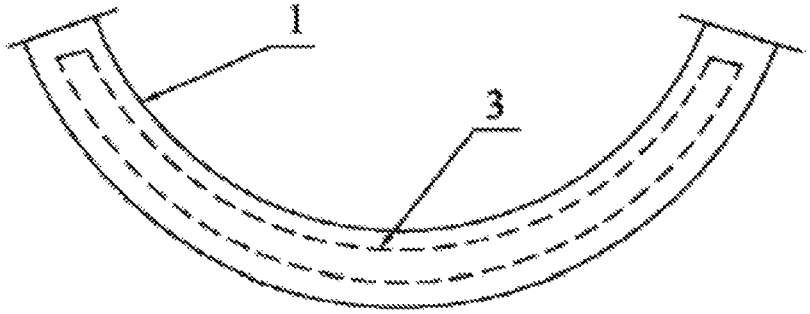

Secondly, as shown in FIG. 4(*a*), the bra wire ring sheath is sewn in a suitable position at the lower edge of the bra cup to make it in an arc shape;

Thirdly, as shown in FIG. 4(*b*), the core wire 2 in the sheath is pulled out, so that a passage is formed in the hollow sheath body for the wire ring to be inserted, then the wire ring 3 is inserted from the port at one end of the passage of the hollow sheath body 1 and passed through the passage to the other end, so that the wire ring 3 is inserted into the hollow sheath body to replace the core wire 2.

Finally, as shown in FIG. 4(*c*), the port parts of the sheath are seam up to avoid the wire ring 3 from penetrating out of the end portion of the sheath.

Such sheath for bra wire ring adopting the above structure ameliorates the problem of resistance when the wire ring is inserted, resulting in that in the process of bra manufacturing, the phenomena of wrinkles and holes left on the surface of wire sheath and the tightness of wire sheath caused by inserting wires can be obviously improved, so that the sheath can provide a soft sense of fluffiness with the wire ring inserted into after the core wire pulled out. Thus, the product is full of beauty and simultaneously enhances the comfort of wearing the bra for females.

The above are only the preferable embodiments of the invention but can't limit the implementation range of the invention, and all the technical schemes realizing the desired advantages of the invention by basically the same means are all within what the invention claims.

The invention claimed is:

1. A sheath for a bra wire ring, the sheath comprising:
- a hollow sheath body made of cloth; and
- a hollow part for holding the wire ring, wherein a core wire is penetrated through the hollow part and is slidable relative to the hollow sheath body.

2. The sheath for bra wire ring according to claim 1, wherein a length of the core wire is not shorter than that of the hollow sheath body.

3. The sheath for bra wire ring according to claim 1, wherein a length of the core wire is equal to that of the hollow sheath body.

4. The sheath for bra wire ring according to claim 1, wherein a width and a thickness of the core wire are greater than those of the wire ring to be inserted so that the core wire can be inserted into the hollow sheath body.

5. The sheath for bra wire ring according to claim 1, wherein a width ratio of the core wire to the hollow sheath body is between ⅓ and ¾.

6. The sheath for bra wire ring according to claim 5, wherein a width ratio of the core wire to the hollow sheath body is between ½ and ⅔.

7. The sheath for bra wire ring according to claim 1, wherein a thickness ratio of the core wire to the hollow sheath body shall be between ¼ and ½.

8. A method for manufacturing bra using the sheath for bra wire ring according to claim 1, wherein the method comprises the following steps:
- preparing the bra wire ring sheath according to claim 1, comprising a hollow sheath body made of cloth, in which a hollow part for holding the wire ring to be inserted is provided, and also comprising a core wire inserted in the hollow part, which may slide relative to the hollow sheath body;
- sewing the sheath in a position at a lower edge of a bra cup;
- pulling out the core wire in the sheath to make the hollow sheath body form a passage for the wire ring to be inserted;
- inserting the wire ring from a port at one end of a passage of the hollow sheath body, and passing the wire ring through the passage to the other end; and
- seaming port parts of the sheath to avoid the wire ring from penetrating out of the port parts of the sheath during wearing.

9. The method according to claim 8, wherein the core wire is woven and synchronously formed with the hollow sheath body.

10. The method according to claim 9, wherein after the core wire is woven and synchronously formed with the hollow sheath body, the core wire is cut into multiple segments having a length matched with a lower edge of the bra cup.

* * * * *